United States Patent [19]

Steck et al.

[11] 4,360,377

[45] Nov. 23, 1982

[54] FERROMAGNETIC METAL PARTICLES, CONSISTING ESSENTIALLY OF IRON AND CARRYING A SURFACE COATING, AND THEIR PRODUCTION

[75] Inventors: Werner Steck, Mutterstadt; Hermann Roller, Ludwigshafen; Wilhelm Sarnecki; Werner Balz, both of Limburgerhof, all of Fed. Rep. of Germany

[73] Assignee: BASF Aktiengesellschaft, Fed. Rep. of Germany

[21] Appl. No.: 278,663

[22] Filed: Jun. 29, 1981

[30] Foreign Application Priority Data

Jul. 15, 1980 [DE] Fed. Rep. of Germany ..... 3026696

[51] Int. Cl.[3] ..... H01F 1/06

[52] U.S. Cl. ..... 75/0.5 AA; 75/251; 148/6.15 R; 148/6.15 Z; 148/6.16; 148/105; 148/6.2

[58] Field of Search ..... 75/0.5 AA, 0.5 AC, 251; 148/31.5, 31.55, 31.57, 6.15 R, 6.15 Z, 6.16, 6.2, 104, 105

[56] References Cited

U.S. PATENT DOCUMENTS 3,837,912 9/1974 Roden .
3,865,627 2/1975 Roden et al. .
3,932,293 1/1976 Roden .

FOREIGN PATENT DOCUMENTS 1299286 6/1964 Fed. Rep. of Germany .
2434058 7/1974 Fed. Rep. of Germany .
2434096 7/1974 Fed. Rep. of Germany .
2646348 10/1976 Fed. Rep. of Germany .
2714588 4/1977 Fed. Rep. of Germany .
2743298 9/1978 Fed. Rep. of Germany .
49-42990 10/1974 Japan .

OTHER PUBLICATIONS

M. Cohen, & A. F. Beck, Z. Elektrochem, 62 (1958), pp. 696–699.

*Primary Examiner*—W. Stallard
*Attorney, Agent, or Firm*—Keil & Witherspoon

[57] ABSTRACT

Ferromagnetic metal particles, consisting essentially of iron and comprising a core, containing not less than 85% by weight of metallic iron, and an iron oxide plus chromium oxide surface layer surrounding this core, which layer additionally contains one or more elements selected from the group comprising zinc, phosphorus in the form of phosphate, aluminum, calcium, strontium, barium, cadmium, lead, cobalt and nickel in a total amount of not more than 9.5% by weight, based on the total amount of the metal particles, and a process for the production of such particles.

4 Claims, No Drawings

FERROMAGNETIC METAL PARTICLES, CONSISTING ESSENTIALLY OF IRON AND CARRYING A SURFACE COATING, AND THEIR PRODUCTION

The present invention relates to ferromagnetic particles, which consist essentially of iron and carry a surface coating of metal oxides which in addition to chromium, iron and oxygen contains other metal ions and/or phosphate ions in a chemically bonded form, and to a process for their production.

The use of Cr(VI) compounds, especially chromates, for the surface oxidation of iron, has long been known from the literature. For example, according to M. Cohen and A. F. Beck, Z. Elektrochem. 62 (1958), 696, the oxide film obtained on treating sheet iron with $Na_2CrO_4$ consists of $\gamma$-$Fe_2O_3$ and $Cr_2O_3$. Further, a process for reducing the ease with which a pyrophoric catalyst ignites in air is disclosed in German Published Application DAS No. 1,299,286, according to which pyrophoric nickel powder or cobalt powder can be converted to a nonpyrophoric metal powder by treatment with a dichromate. In the case of finely divided metal particles, based on iron, cobalt or nickel, which are particularly suitable as magnetizable materials for the production of magnetic recording media, a treatment of the particle surface with chromium(VI) compounds to reduce the chemical reactivity, both in respect of the pyrophoric nature of the particles and in respect of their stability after incorporation into the coating binder, has been proposed (U.S. Pat. Nos. 3,837,912, 3,932,293 and 3,865,627). The surface layer is said to consist not only of the elements which form the actual metal particles or core (Me=Fe, Co or Ni), but also of a chromite of the formula $Me_xCr_{3-x}O_4$ where x is about 0.85. An attempt has also been made, as described in Japanese Published Application No. 42,990/76, to protect the surface of finely divided ferromagnetic metal particles by another method known from conventional surface treatment of iron, namely phosphatizing.

It is true that the ferromagnetic metal particles suitable for the production of magnetic recording media can be stabilized by these conventional processes. Since, however, these metal particles must—because of the requisite magnetic properties—have small dimensions, for example a length/width ratio greater than 2:1, and usually greater than 4–5:1, coupled with a mean particle diameter of as little as about 20–100 nm, chemical attack has a significant effect on the substance, because of the relatively large surface area, and accordingly also on the magnetic properties of the material.

There have therefore been many attempts to stabilize the finely divided magnetic metal particles without adversely affecting their magnetic properties. Accordingly, it is an object of the present invention to provide ferromagnetic metal particles which have improved magnetic properties, reduced reactivity (reduced pyrophoric character) and sufficient stability to environmental factors, and which, in particular, give magnetic recording media having advantageous mechanical properties.

We have found that this object is achieved with ferromagnetic metal particles, consisting essentially of iron and comprising a core, containing not less than 85% by weight of metallic iron, and an iron oxide plus chromium oxide surface layer surrounding this core, if only the surface layer contains, in addition to iron, oxygen and from 1 to 9% by weight of chromium, based on the total amount of the metal particles, one or more elements selected from the group comprising zinc, phosphorus in the form of phosphate, aluminum, calcium, strontium, barium, cadmium, lead, cobalt and nickel, in a total amount of not more than 9.5% by weight, based on the total amount of the metal particles.

The invention also relates to a process for the production of the ferromagnetic metal particles according to the invention.

The ferromagnetic metal particles according to the invention thus consist of a core which contains not less than 85% by weight of metallic iron and is produced as a pyrophoric particle, usually by reducing $\alpha$- or $\gamma$-iron(III) oxide hydroxide, or a mixture of these or their dehydration products, which oxides have advantageously been subjected to a shape-stabilizing treatment, for example as described in German Laid-Open Applications DOS Nos. 2,434,058, 2,434,096, 2,646,348, 2,714,588 and 2,743,298, prior to a reduction. An iron oxide plus chromium oxide surface layer is then formed on the pyrophoric particle by treatment with a solution containing a chromium(VI) compound, and this surface layer is modified with one or more of the elements mentioned above, either during formation of the layer or immediately thereafter.

It may be assumed that the surface layer surrounding the core has the structure of a chromium spinel of the general formula $(Me(II)O).[Me(III)]_2O_3$. This surface layer is then modified by the incorporation of divalent or trivalent metal ions or of combinations thereof. Because of the high oxidizing power of Cr(VI) compounds, preferred divalent metal ions (X) are those which are stable to oxidation under the selected conditions. Suitable ions include the divalent alkaline earth metal ions Ca(II), Sr(II) and Ba(II), as well as Pb(II) and divalent metal ions of the transition metals of the periodic table of the elements, such as Zn(II), Cd(II), Co(II) and Ni(II). Amongst the Me(II) ions mentioned, Zn is especially preferred. Combinations of the said Me(II) ions can also be used to modify the surface layer. It is advantageous to add divalent cations which are stable to oxidation because in the absence of such cations there is a deficit of divalent ions for chromite formation. However, the incorporation of Al(III) ions has also proved advantageous. In view of the combination of divalent and trivalent metal ions, the chromite which forms the surface layer may be expected to have a composition according to the formula $$\underbrace{(Fe,X)O}_{Me(II)}.\underbrace{(Cr,\ Fe,\ Al)_2}_{Me(III)}.O_3$$

The divalent and/or trivalent metal ions which, according to the invention, are present in the surface layer are advantageously employed in the form of their aqueous solutions. Accordingly, soluble salts of inorganic or organic acids, for example sulfates, chlorides and acetates, are particularly suitable for the preparation of such solutions. Salts which, as in the case of the nitrates, can have an oxidizing action on iron have not been used since this can result in oxide surface layers having different properties from those required. Equally, the anions of the chosen salts should have little or no reducing action under the chosen conditions, so that during the treatment with Cr(VI) the yield (? of oxidized iron), based on Cr(VI), is of advantageous magnitude.

Further, it has proved advantageous to include, in the surface layer consisting of iron, chromium and oxygen ions, phosphate ions ($PO_4^{3-}$) in place of additional metal ions, or phosphate ions together with another metal ion, or phosphate ions and combinations of metal ions. The formation—which thus becomes possible—of sparingly soluble Me(II) phosphates and/or Me(III) phosphates, for example $Zn_3(PO_4)_2$, $CrPO_4$, $FePO_4$ or $AlPO_4$, also gives surface layers having advantageous properties.

The production of the ferromagnetic metal particles according to the invention starts from the conventional treatment with chromium(VI) compounds. During the treatment of the metal particles with an aqueous solution of a Cr(VI) compound, the pH rapidly shifts to alkaline values and can almost reach 13.

Equation (1) shows a possible reaction whereby these $OH^-$ ions may be liberated.

$$2Fe+Cr_2O_7^{2-}+H_2O \rightarrow Fe_2O_3+Cr_2O_3+2OH^- \quad (1)$$

Since it is usual to start from acidic Cr(VI) solutions, it is advisable to add acid in order to obtain constant pH conditions and accordingly constant oxidation conditions. In the process according to the invention, the pH can be regulated with the aid of the metal salts which are suitable for forming the surface layer, either by hydrolysis of acidic metal salts, such as zinc chloride, or by precipitation of the liberated $OH^-$ ions as metal hydroxides. This ensures that the added oxidizing agent is substantially consumed and that a product which is free from chromium(VI)—such freedom being necessary for the subsequent use of the product—is obtained.

Suitable chromium(VI) compounds are dichromates, eg. $K_2Cr_2O_7$ or $Na_2Cr_2O_7$, chromates, eg. $Na_2CrO_4$ or $K_2CrO_4$ and chromium(VI) oxide ($CrO_3$). The aqueous solutions of the said Cr(VI) compounds can, if required, be brought to an acid pH by addition of an acid such as $H_2SO_4$, HCl or $H_3PO_4$.

The proportion of chromium incorporated into the surface layer can be varied by varying the experimental conditions, such as the pH, temperature and amount of Cr(VI) employed, larger amounts of Cr(VI) resulting, as expected, in the increased incorporation of chromium.

It has proved advantageous to deposit from 1 to 9% by weight of chromium, based on the total weight of the particles, onto the metal particles. The Cr(VI) solutions used can contain from 10 to 230 g of Cr(VI) per kg of metal pigment employed, depending on the amount of chromium to be incorporated. However, solutions which contain from 25 to 80 g of Cr(VI) per kg of metal pigment are preferred.

The metal particles are treated with Cr(VI) compounds by stirring in aqueous suspension, dilutions (ie. weight ratios of pigment to solution of from 1:5 to about 1:20) having proved advantageous. If the dilution is 1:10, the pH—obtained, if necessary, by adding acid—should be not less than 2.3. For other dilutions, this minimum pH can easily be determined by experiments.

In order to repress the pickling action of acid on the metal pigment in an acidic solution or acidic suspension, it is advantageous to add conventional inhibitors, known in the metal pickling art, to such treatment solutions or suspensions when carrying out the treatment of the metal particles. The addition of inhibitors which adhere adsorptively to the metal represses the direct attack of acid on the metal surface and hence represses the dissolution of metal by protons. The inhibitors do not interfere with the formation of the surface layer according to the invention. Some suitable inhibitors and their use in pickling treatments are described, for example, in Z. Metallkunde 69 (1978), 1–7. According to this publication, examples of suitable inhibitors are diphenylthiourea, propargyl alcohol and 1,4-butynediol.

The treatment temperature should be from 15° to about 75° C., especially from room temperature to 70° C. The treatment time is from about 2 to 30 minutes.

The process embodiments for the production of the surface layers of the metal particles according to the invention which are described below have proved particularly advantageous.

After completion of the treatment of the metal particles with Cr(VI) compounds, an aqueous solution of the divalent and/or trivalent metal ions is added to the alkaline suspension. In this way, the corresponding metal hydroxides can be precipitated on the pigment surface. Advantageously, the precipitation of the hydroxides reduces the pH of the suspension, and this facilitates subsequent filtration, and washing of the treated pigments. At what pH the addition of the metal ions is stopped depends on the amount of metal ions being incorporated and on the solubilities of the hydroxides formed. For example, the solubility minimum of $Cd(OH)_2$ is at about pH 11 and that of $Zn(OH)_2$ is at about 9.5. If the solubilities of the metal hydroxides formed are sufficiently low, for example less than about 0.5 g of metal ion/liter, addition of the metal ions, to precipitate the hydroxide, can be continued until the mixture is slightly acidic. Where appropriate, the amount of hydroxide precipitated can be increased, after completion of the Cr(VI) treatment, by adding a base so as further to raise the pH which is already in the alkaline range.

After these precipitates are formed on the chromium(VI)-treated metal particles, the product obtained is separated from the liquid by filtration and is washed if necessary. Washing can be effected with water, with mixtures of water and water-soluble organic solvents, or with the above organic solvents alone. Where appropriate, reducing agents can be added to the wash liquids, these being oxidized by Cr(VI) compounds under the chosen operating conditions. This reduces chromium(VI), which may be present in the filter cake due to inadequate washing, to Cr(III). Examples of suitable reducing agents are Fe(II) ions, sulfites ($SO_3^{2-}$, $HSO_3^-$), hydrazine and its salts, hydroxylamine, formaldehyde and easily oxidizable organic compounds, for example ascorbic acid. Aqueous wash solutions of reducing agents whose oxidation products are gaseous, easily soluble, easily washed out or in any case already present in the surface layer of the metal particle are preferred.

Following the above treatments, the product obtained is dried and the metal particles according to the invention are heated to complete the formation of the surface layer. Drying and heating are carried out under reduced pressure or, preferably, under atmospheric pressure and, depending on the method chosen, at from 80° to 320° C. for from 0.5 to 8 hours. Over this period, the drying and heating operations are as a rule carried out simultaneously, in one process step, but they can of course also be carried out in two separate steps. Though at low treatment temperatures small amounts of oxygen in the surrounding gas atmosphere present little problem, the drying and heating operations are preferably carried out under an inert gas, for example nitrogen or a noble gas. Drying under atmospheric pressure at from about 80° to 320° C. gives materials which do not ignite spontaneously in air at room temperature.

The treatment of the metal particles, so as to obtain the particles provided with a surface layer according to the invention, can also be carried out by regulating the pH to the desired value during the actual Cr(VI) treatment by adding divalent and/or trivalent metal ions, and by the hydroxide precipitation resulting therefrom. The advantageous pH for the particular metal ions added can be deduced from the solubilities of the corresponding hydroxides. It is advantageous to use metal salts which because of hydrolysis give an acidic reaction, for example $ZnCl_2$.

If the metal particles according to the invention are to have surface layers containing Me(II) ions which, as in the case of Ca, Sr, Ba, Cd, Zn or Pb, form sparingly soluble chromates $Me(II)CrO_4$, it is advantageous to add the corresponding metal compounds at a pH in the alkaline range after completion of the chromium(VI) treatment of the metal particles. To do so, it is advantageous if the filter cake obtained after the chromium(VI) treatment is resuspended in water—with or without having been prewashed with water—and the intended amount of Me(II) ions is then added to the suspension, whilst stirring.

If phosphorus in the form of phosphate is selected from the group of modifying elements for the surface layer of the metal particles according to the invention, it was found, in the course of the development of the process according to the invention, to be advantageous either to regulate the pH during the chromium(VI) treatment of the metal particles by adding phosphoric acid at that stage, or even to add the phosphate ion, in the form of primary, secondary or tertiary phosphates, to the aqueous solution of the chromium(VI) compound. If, in addition to the phosphate ion, one or more of the above elements are to be incorporated into the surface layer of the metal particles according to the invention, this is advantageously achieved by a combination of the procedures mentioned above.

Particularly suitable metal particles according to the invention are those which have a surface layer which in addition to iron, oxygen and from 1 to 9% by weight of chromium, based on the total weight of the metal particles, contains one or more of the elements specified below, in the amount indicated:

| | |
|---|---|
| Zinc: | 0.4–5% by weight |
| Phosphorus (in the form of phosphate): | 0.35–1.2% by weight (ie. 1.0–3.4% of $PO_4^{3-}$) |
| Aluminum: | 0.4–3% by weight |
| Calcium: | 0.3–3% by weight |

-continued

| | |
|---|---|
| Strontium: | 0.4–4% by weight |
| Barium: | 0.5–8% by weight |
| Cadmium: | 0.4–8% by weight |
| Lead: | 0.5–8% by weight |
| Cobalt: | 0.4–4% by weight |
| Nickel: | 0.4–4% by weight |

The resulting metal particles according to the invention have not only greater stability but also better magnetic properties. They are consequently exceptionally suitable for use in the production of magnetic recording media, since, precisely because of their greater stability, they can be incorporated more easily into the binder systems which form the magnetic layer and since important mechanical properties of the magnetic recording media are improved at the same time.

The advantages of the metal particles according to the invention are shown with the aid of the Examples in comparison with the Comparative Experiments carried out according to the prior art.

The magnetic properties of the metal powders were measured by means of a vibrating sample magnetometer, at a field strength of 160 kA/m. The coercive force $H_c$, measured in kA/m, was based on a tamped density of the magnetic pigment of $\rho = 1.6$ g/cm$^3$. The specific remanence $M_r/\rho$ and the specific saturation magnetization $M_m/\rho$ are each quoted in nTm$^3$/g.

EXAMPLE 1

100 g portions of a pyrophoric metal pigment (magnetic properties shown in Table 1), prepared by reducing acicular goethite, having a particle length of 0.51 μm and a length/width ratio of 28.3:1, with hydrogen in a fluidized bed furnace at 350° C. are suspended in 1,000 ml of water at 30° C. To these suspensions are then added, with stirring, 1.2 g (Experiment 1A), 2.5 g (Experiment 1B) or 7.5 g (Experiment 1C) of chromium(VI) ions in the form of an aqueous potassium dichromate solution. After 5 minutes, a solution of 5.4 g (Experiment 1A), 11 g (Experiment 1B) or 21.2 g (Experiment 1C) of $ZnSO_4.7H_2O$, dissolved in 100 ml of water, is added to the particular batch, and after a further 5 minutes the solids are filtered off. The product is washed with water and then heated under nitrogen in a rotary kiln at 150° C. for 3 hours. The pH of the suspension of the finished particles in water, analytical results and magnetic properties of the metal particles are shown in Table 1.

COMPARATIVE EXPERIMENT 1

The procedure described in Example 1 is followed, but without adding the zinc sulfate solution. The results are shown in Table 1.

TABLE 1

| | pH | Cr % by weight | Zn % by weight | $H_c$ | $M_r/\rho$ | $M_m/\rho$ | $^{30}M_r/M_m$ |
|---|---|---|---|---|---|---|---|
| Example 1 A | 8.4 | 1.2 | 1.2 | 71.9 | 72 | 124 | 0.58 |
| Example 1 B | 8.2 | 2.2 | 2.1 | 73.3 | 67 | 114 | 0.59 |
| Example 1 C | 9.2 | 5.6 | 3.8 | 73.7 | 64 | 102 | 0.63 |
| Comparative Experiment 1 A | 10.0 | 1.1 | — | 70.4 | 64 | 114 | 0.56 |
| Comparative Experiment 1 B | 11.2 | 2.2 | — | 68.8 | 64 | 115 | 0.56 |
| Comparative Experiment 1 C | 11.6 | 5.4 | — | 69.6 | 57 | 104 | 0.55 |
| Pyrophoric metal | — | — | — | 70.7 | 94 | 154 | 0.61 |

TABLE 1-continued

| | pH | Cr % by weight | Zn % by weight | $H_c$ | $M_r/\rho$ | $M_m/\rho$ | $^{30}M_r/M_m$ |
|---|---|---|---|---|---|---|---|
| particles | | | | | | | |

$^{+}M_r/M_m$ = relative remanence

EXAMPLE 2

100 g of a pyrophoric metal pigment, prepared by reducing acicular goethite, having a particle length of 0.51 μm and a length/width ratio of 28.3:1, with hydrogen in a fluidized bed furnace at 350° C., are suspended in 1,000 ml of water at 30° C. 7.5 g of chromium(VI) ions in the form of an aqueous potassium dichromate solution are then added to the suspension, with stirring. After 10 minutes' stirring, the pH of the suspension is 11.3. 19.8 g of $ZnSO_4.7H_2O$, dissolved in 75 ml of water, are then added in order to give a pH of 7 and to precipitate the hydroxide, and stirring is continued for a further 3 minutes. The end product is worked up as described in Example 1. The results are shown in Table 2.

EXAMPLE 3

The procedure described in Example 2 is followed, but instead of the zinc sulfate solution 15.1 g of $Zn(CH_3COO)_2.2H_2O$, dissolved in 80 ml of water, are added. The results are shown in Table 2.

EXAMPLE 4

The procedure described in Example 2 is followed, but instead of the zinc sulfate solution 32.4 g of the zinc disodium salt of ethylenediaminetetraacetic acid, dissolved in 80 ml of water, are added. The results are shown in Table 2.

EXAMPLE 5

31.5 g of potassium dichromate are dissolved in 1,500 ml of water and the pH is adjusted to 2.5 by adding sulfuric acid. 150 g of metal particles, prepared as described in Example 1, are then introduced, with stirring, into the solution. After stirring for a further 10 minutes, the pH is 11.4. 29.7 g of $ZnSO_4.7H_2O$, dissolved in 100 ml of water, are then added in the course of 3 minutes. The end product is worked up as described in Example 1. The results are shown in Table 2.

EXAMPLE 6

31.5 g of potassium dichromate are dissolved in 1,500 ml of water and the pH is adjusted to 2.5 by adding sulfuric acid. 150 g of metal particles, prepared as described in Example 1, are then introduced, with stirring, into the solution. Immediately after the pH has risen from 2.5 to 7, the addition of the zinc sulfate solution is started, and the pH is thereby kept constant. When a total of 38.6 g of $ZnSO_4.7H_2O$, dissolved in 130 ml of water, has been added, the reaction is terminated. The end product is worked up as described in Example 1. The results are shown in Table 2.

COMPARATIVE EXPERIMENT 2

The procedure described in Example 1C is followed, but without adding a zinc sulfate solution. The results are shown in Table 2.

TABLE 2

| | Cr % by weight | Zn % by weight | $H_c$ | $M_r/\rho$ | $M_m/\rho$ | $M_r/M_m$ |
|---|---|---|---|---|---|---|
| Example 2 | 5.4 | 3.9 | 70.1 | 105 | 59 | 0.56 |
| Example 3 | 5.6 | 3.7 | 69.7 | 104 | 59 | 0.57 |
| Example 4 | 5.4 | 0.4 | 65.6 | 110 | 60 | 0.55 |
| Example 5 | 5.5 | 3.5 | 73.3 | 107 | 63 | 0.59 |
| Example 6 | 5.6 | 3.8 | 72.5 | 105 | 62 | 0.59 |
| Comparative Experiment 2 | 5.2 | — | 66.0 | 106 | 58 | 0.55 |

EXAMPLE 7

The procedure described in Example 2 is followed, but instead of the zinc sulfate solution the salts of calcium, strontium, barium, cadmium and nickel shown in Table 3, in the specified amounts, are added—in each case in the form of a solution in 100 ml of water—to the suspension.

Working up is carried out as described in Example 1. The results are also shown in Table 3.

COMPARATIVE EXPERIMENT 3

The procedure described in Example 7 is followed, but without adding a further salt solution. The results are shown in Table 3.

TABLE 3

| | Me(II) salt used as modifier | Cr % by weight | Me(II) % by weight | $H_c$ | $M_m/\rho$ | $M_r/M_m$ |
|---|---|---|---|---|---|---|
| Example 7 | 14.7 g of $CaCl_2.2H_2O$ | 5.7 | 2.4 | 72.6 | 110 | 66 |
| | 26.6 g of $SrCl_2.6H_2O$ | 5.0 | 3.4 | 73.2 | 109 | 64 |
| | 24.4 g of $BaCl_2.2H_2O$ | 5.3 | 8.0 | 72.9 | 107 | 63 |
| | 20.1 g of $CdCl_2.H_2O$ | 5.2 | 7.9 | 73.4 | 103 | 62 |
| | 23.8 g of $NiCl_2.6H_2O$ | 5.2 | 3.7 | 67.6 | 101 | 57 |
| Comparative Experiment 3 | — | 5.0 | — | 63.7 | 105 | 55 |

EXAMPLE 8

A pyrophoric iron pigment prepared as described in Example 1 is treated as described in Example 1, except that the initial charge of $K_2Cr_2O_7$ and water is brought to a pH of 2.3 with dilute sulfuric acid. The temperature of this initial charge is 22° C. 150 g of metal pigment are introduced, with stirring, into the initial charge of 2,250 ml of water plus the Cr(VI) compound. Thereafter the pH is brought to 12 by adding NaOH and a solution of 150 g of $Al_2(SO_4)_3.18H_2O$ and 60 g of $ZnSO_4.7H_2O$ in 200 ml of water is then added.

By adding the aqueous solution of the modifiers, the pH drops to 7 and the corresponding metal hydroxides are precipitated on the pigment surface. Following the procedure described in Example 1, the product is filtered off, washed and then dried and heated for 8 hours at 150° C. in a rotary kiln under an inert gas. The results are shown in Table 4.

EXAMPLE 9

The procedure described in Example 8 is followed, but instead of the aluminum sulfate/zinc sulfate solution, a solution of 25 g of $CoCl_2.6H_2O$ dissolved in 200 ml of water is used. The results are shown in Table 4.

COMPARATIVE EXPERIMENT 4

The procedure described in Example 8 is followed, but the treatment of the metal particles is terminated 10 minutes after addition of the chromium(VI) compound. The results are shown in Table 4.

TABLE 4

| | Cr % by weight | Me % by weight | $H_c$ | $M_m/\rho$ | $M_r/\rho$ |
|---|---|---|---|---|---|
| Example 8 | 5.5 | Zn:0.89 Al:0.95 | 65.5 | 94 | 52 |
| Example 9 | 5.5 | Co:3.2 | 64.4 | 93 | 52 |
| Comparative Experiment 4 | 4.7 | — | 59.2 | 97 | 52 |

EXAMPLE 10

An initial charge of 31.5 g of $K_2Cr_2O_7$ and 2,250 ml of water, having a pH of 3.8, is brought to a pH of 2.5 with phosphoric acid ($H_3PO_4$). 150 g of a pyrophoric metal pigment, prepared as described in Example 1 and having the magnetic properties shown in Table 5, are then introduced, with stirring, into the initial charge. After 10 minutes, stirring is stopped, the product is filtered off and the filter cake is washed, dried and heated, as described in Example 1. The results are shown in Table 5.

EXAMPLE 11

The procedure described in Example 10 is followed, except that 5 g of 2-butynediol, to serve as a pickling inhibitor, are additionally dissolved in the aqueous solution of potassium dichromate and phosphoric acid. The results are shown in Table 5.

EXAMPLE 12

The procedure described in Example 11 is followed, except that propargyl alcohol, again in an amount of 5 g, is added as the pickling inhibitor. The results are shown in Table 5.

EXAMPLE 13

31.5 g of $K_2Cr_2O_7$ are dissolved in 2,250 ml of water and the pH is brought to 2.5 by adding $H_2SO_4$. 150 g of the pyrophoric metal pigment described in Example 10 are then added, with stirring, and the pH of the suspension is kept at 7 for 10 minutes by adding dilute phosphoric acid. The batch is then worked up as described in Example 1. The results are shown in Table 5.

TABLE 5

| | Cr % by weight | $PO_4^{3-}$ | $H_c$ | $M_m/\rho$ | $M_r/\rho$ |
|---|---|---|---|---|---|
| Example 10 | 5.2 | 1.3 | 71.2 | 102 | 58 |
| Example 11 | 5.1 | 1.3 | 70.6 | 100 | 56 |
| Example 12 | 5.0 | 1.3 | 70.7 | 106 | 61 |
| Example 13 | 5.6 | 3.0 | 74.3 | 104 | 61 |

TABLE 5-continued

| | Cr % by weight | $PO_4^{3-}$ | $H_c$ | $M_m/\rho$ | $M_r/\rho$ |
|---|---|---|---|---|---|
| Pyrophoric metal pigment | — | — | 70.8 | 152 | 94 |

EXAMPLE 14

2,250 ml of $H_2O$ are brought to a pH of 2.3 with $H_3PO_4$. 150 g of a pyrophoric metal pigment, prepared as described in Example 1 and having the magnetic properties shown in Table 6, are then added, with stirring. Two minutes thereafter, a solution which consists of 31.5 g of $K_2Cr_2O_7$, 300 ml of water and $H_3PO_4$ and which has a pH of 2.3 is added and stirring is then continued for 8 minutes. The batch is worked up as described in Example 1. The results are shown in Table 6.

EXAMPLE 15

The procedure described in Example 14 is followed, but 3 minutes after the addition of the $K_2Cr_2O_7$ solution containing phosphoric acid the pH is brought to 12.0 with an aqueous NaOH solution. A solution of 37.5 g of $ZnSO_4.7H_2O$ in 125 ml of water is then added dropwise, giving a pH of 7.0. After 5 minutes, the mixture is worked up as previously described. The results are shown in Table 6.

EXAMPLE 16

150 g of the pyrophoric metal pigment described in Example 14 are added, with stirring, to an initial charge, at pH 2.3, of 31.5 g of $K_2Cr_2O_7$, 5 g of propargyl alcohol, $H_2SO_4$ and 2,250 ml of water. After 4 minutes, the pH, which in the interim has risen to 10, is brought to 7 by dropwise addition of a solution of 31.5 g of $ZnSO_4.7H_2O$, 50 ml of $H_2O$ and 50 ml of dilute phosphoric acid, and is maintained at this value for a further 5 minutes by continued dropwise addition. The batch is then worked up. The results are shown in Table 6.

TABLE 6

| | Cr | $PO_4^{3-}$ | Zn | $H_c$ | $M_m/\rho$ | $M_r/\rho$ |
|---|---|---|---|---|---|---|
| | % by weight | | | | | |
| Pyrophoric metal pigment | — | — | — | 64.3 | 140 | 83 |
| Example 14 | 4.0 | 1.8 | — | 63.1 | 105 | 59 |
| Example 15 | 4.1 | 2.3 | 3.7 | 65.0 | 103 | 60 |
| Example 16 | 4.0 | 2.1 | 0.68 | 64.5 | 105 | 60 |

COMPARATIVE EXAMPLE 5

11.1 g of $K_2Cr_2O_7$ dissolved in 2,250 ml of water are introduced into a beaker at 23° C. The pH is brought to 4.0 by adding sulfuric acid and 150 g of a pyrophoric metal pigment, prepared as described in Example 1 and having the magnetic properties shown in Table 7, are introduced, with stirring. After 10 minutes, stirring is stopped, the mixture is filtered and the filter cake is washed, dried and heated, as described in Example 1. The results are shown in Table 7.

TABLE 7

| | Cr % by weight | $H_c$ | $M_m/\rho$ | $M_r/\rho$ |
|---|---|---|---|---|
| Comparative Experiment 5 | 3.6 | 64.2 | 107 | 60 |

TABLE 7-continued

| | Cr % by weight | $H_c$ | $M_m/\rho$ | $M_r/\rho$ |
|---|---|---|---|---|
| Pyrophoric metal pigment | — | 67.8 | 133 | 81 |

EXAMPLE 17

1,800 g of steel balls having a diameter of 4 mm, 100 parts of the particular metal particles shown in Table 8, 3 parts of lecithin, 3 parts of an ester of $C_{16}$–$C_{18}$-fatty acids and a glycol, 110 parts of a solvent mixture of equal parts of THF and dioxane and 127 parts of a 13.5% strength binder prepared by dissolving 13.75 parts of an elastomeric polyether-urethane (obtained from adipic acid, 1,4-butanediol and 4,4'-diisocyanatodiphenylmethane) and 3.4 parts of a polyphenoxy resin, of molecular weight 30,000, in 109.85 parts of a mixture of equal parts of tetrahydrofuran and dioxane are introduced into a laboratory stirred ball mill of 1.8 liters capacity, and the charge is finely milled for 14 hous at 1,500 rpm. When dispersion has been completed, 6.3 parts of a 75% strength solution of a triisocyanate, prepared from 3 moles of toluylene diisocyanate and 1 mole of 1,1,1-trimethylolpropane in ethyl acetate, are added to the charge and the mixture is stirred for a further 15 minutes. The dispersion is filtered and then coated onto a 12 μm thick polyethylene terephthalate film, following which the metal particles are oriented by means of a permanent magnet. After the magnetic layer has been dried, it is calendered by passing the coated film between heated steel rolls; the resulting magnetic layer is 4 μm thick. The magnetic films thus produced are slit into 3.81 mm wide tapes which are then tested. The results are shown in Table 8.

Coefficient of friction

The coefficient of friction of the magnetic tape is measured before, and after, the durability test described below.

Durability test

A loop of tape 95 cm long is drawn over an assembly of magnetic heads at a speed of 4 m/sec for 1 hour. The weight loss (abrasion) of the tape in milligrams is determined. The durability test gives a clear indication of the tendency of the tape to form head deposits and of the wear resistance (weight loss).

TABLE 8

| Example | Metal particles employed | $H_c$ | $M_r$ lengthwise / $M_r$ crosswise | Coefficient of friction before durability test | Coefficient of friction after durability test | Abrasion [mg] |
|---|---|---|---|---|---|---|
| 17/1 | Starting material of Example 1 | 70.7 | 2.0 | 0.44 | not measurable | 14.7 |
| 17/2 | Example 2 | 75.1 | 1.9 | 0.34 | 0.35 | 2.7 |
| 17/3 | Example 9 | 79.9 | 2.0 | 0.33 | 0.43 | 0.9 |
| 17/4 | Example 13 | 80.1 | 2.5 | 0.34 | 0.40 | 1.6 |
| 17/5 | Example 15 | 77.1 | 2.0 | 0.31 | 0.40 | 1.6 |
| 17/6 | Comparative Experiment 5 | 77.0 | 2.0 | 0.41 | 0.43 | 6.3 |

We claim:

1. Ferromagnetic metal particles, consisting essentially of iron and comprising a core, containing not less than 85% by weight of metallic iron, and an iron oxide plus chromium oxide surface layer surrounding this core, wherein in the surface layer contains, in addition to iron, oxygen and from 1 to 9% by weight of chromium, based on the total amount of the metal particles, at least one element selected from the group comprising zinc, phosphorus in the form of phosphate, aluminum, calcium, strontium, barium, cadmium, lead, cobalt and nickel, in a total amount of not more than 9.5% by weight, based on the total amount of the metal particles.

2. Ferromagnetic metal particles consisting essentially of iron, as claimed in claim 1, wherein the surface layer contains, in addition to iron, oxygen and from 1 to 9% by weight of chromium, based on the total amount of the metal particles, at least one of the following elements in the amounts specified below:

| | |
|---|---|
| Zinc: | 0.4–5% by weight |
| Phosphorus (in the form of phosphate) | 0.3–1.2% by weight (ie. 1.0–3.4% of $PO_4^{3-}$) |
| Aluminum: | 0.4–3% by weight |
| Calcium: | 0.3–3% by weight |
| Strontium: | 0.4–4% by weight |
| Barium: | 0.5–8% by weight |
| Cadmium: | 0.4–8% by weight |
| Lead: | 0.5–8% by weight |
| Cobalt: | 0.4–4% by weight |
| Nickel: | 0.4–4% by weight |

3. A process for the production of the ferromagnetic metal particles, consisting essentially of iron, as claimed in claim 1 or 2, wherein, during the formation of the chromium-containing surface layer by treating the metal particles with a solution of a Cr(VI) compound, the metal ions of at least one element selected from the group comprising zinc, aluminum, calcium, strontium, barium, cadmium, lead, cobalt and nickel, or phosphate ions, or the ions of at least one of these metals plus phosphate ions, are added to the solution and precipitated on the surface of the metal particles, and the resulting material is then heat-treated at from 80° to 320° C. for from 0.5 to 8 hours.

4. A process for the production of the ferromagnetic metal particles, consisting essentially of iron, as claimed in claim 1 or 2, wherein, after the formation of the chromium-containing surface layer by treating the metal particles with a solution of a chromium(VI) compound, the metal ions of at least one element selected from the group comprising zinc, aluminum, calcium, strontium, barium, cadmium, lead, cobalt and nickel, or phosphate ions, or the metal ions of at least one of these metals plus phosphate ions, are precipitated on the surface of the metal particles, and the resulting material is then heat-treated at from 80° to 320° C. for from 0.5 to 8 hours.

* * * * *